US005754084A

United States Patent [19]

Hietala

[11] Patent Number: 5,754,084

[45] **Date of Patent: *May 19, 1998**

[54] TEMPERATURE-COMPENSATED RESONATOR

[75] Inventor: Arto Hietala, Oulu, Finland

[73] Assignee: Nokia Telecommunications Oy, Espoo, Finland

[ * ] Notice: The term of this patent shall not extend beyond the expiration date of Pat. No. 5,686,874.

[21] Appl. No.: 632,399

[22] PCT Filed: Oct. 19, 1994

[86] PCT No.: PCT/FI94/00470

§ 371 Date: Apr. 19, 1996

§ 102(e) Date: Apr. 19, 1996

[87] PCT Pub. No.: WO95/11529

PCT Pub. Date: Apr. 27, 1995

[30] Foreign Application Priority Data

Oct. 20, 1993 [FI] Finland ..... 934630

[51] Int. Cl.[6] ..... H01P 1/30; H01P 7/06

[52] U.S. Cl. ..... 333/229; 333/232; 333/234

[58] Field of Search ..... 333/214, 222, 333/224, 226, 229, 234, 235, 231, 232

[56] References Cited

U.S. PATENT DOCUMENTS

| | | | |
|---|---|---|---|
| 2,103,515 | 12/1937 | Conklin et al. | 333/234 |
| 3,160,825 | 12/1964 | Derr | 333/229 X |
| 3,187,278 | 6/1965 | Wheeler | 333/226 |
| 4,292,610 | 9/1981 | Makimoto et al. | 333/222 |
| 4,521,754 | 6/1985 | Ranghelli et al. | 333/224 |
| 4,933,652 | 6/1990 | Gaukel | 333/225 |
| 5,216,388 | 6/1993 | Dipoala | 333/229 X |

FOREIGN PATENT DOCUMENTS

| | | |
|---|---|---|
| 2 342 564 | 9/1977 | France . |
| 28 09 363 | 11/1978 | Germany . |
| 415 063 | 11/1978 | Sweden . |

*Primary Examiner*—Seungsook Ham

*Attorney, Agent, or Firm*—IP Group of Pillsbury Madison & Sutro LLP

[57] ABSTRACT

A temperature-compensated resonator including a control rod disposed in a resonator housing for controlling the center resonance frequency provided by the resonator; a conductor tube secured to the housing and coaxially disposed around the control rod; a regulating tube which is attached to the inner end of the control rod and which is coaxial with the control rod and the conductor tube; and temperature-compensator for compensating for longitudinal changes exhibited by the unit consisting of the control rod, the conductor tube and the regulating tube for changes in temperature. To reduce the length of the resonator, the temperature-compensator includes a temperature-compensation tube which moves the control rod in proportion to variations in temperature and which is disposed within the conductor tube and secured to the inner end of the conductor tube.

7 Claims, 1 Drawing Sheet

TEMPERATURE-COMPENSATED RESONATOR

This application claims benefit of international application PCT/FI94/00470 filed Oct. 19, 1994 published as WO95/11529 Apr. 27, 1995.

BACKGROUND OF THE INVENTION

The invention relates to a temperature-compensated signal resonator comprising a control rod disposed in a resonator housing for controlling the center resonance frequency; a conductor tube secured to the housing and coaxially disposed around the control rod; a regulating tube which is attached to the inner end of the control rod and which is coaxial with the control rod and the conductor tube; and temperature-compensation means for compensating for longitudinal changes exhibited by the unit consisting of the control rod, the conductor tube and the regulating tube for changes in temperature.

Similar resonator are known from the prior art: e.g. the resonator manufactured by CELWAVE Division of Radio Frequency Systems, Inc., a unit of Alcatel Network Systems, headquartered in Richardson, Tex., where temperature compensation is implemented by a temperature-compensation device projecting from the exterior surface of the resonator housing. A significant drawback of this solution is that the resonator takes up a lot of space. The size of the resonator further increases if it is to be controlled automatically, in which case a stepper motor has to be connected to the control rod.

SUMMARY OF THE INVENTION

The object of the present invention is to obviate the above-mentioned drawback. This is achieved with a resonator of the type described in the foregoing BACKGROUND section, this resonator being characterized according to the invention in that the temperature-compensation means comprise a temperature-compensation tube which moves the control rod in proportion to variations in temperature and which is disposed within the conductor tube and secured to the inner end of the conductor tube.

The most significant advantage of the invention is that the temperature-compensated resonator of the invention is clearly shorter than resonators of the prior art. To implement temperature compensation in accordance with the invention does not increase the size of the resonator—at least not its length—since the temperature-compensation means of the invention can be positioned entirely within a conventional resonator housing.

Another significant advantage is that by widening the conductor tube suitably, it is possible to mount a stepper motor at the end of the control rod.

BRIEF DESCRIPTION OF THE DRAWING

In the following, the invention will be described in greater detail by means of two preferred embodiments and with reference to the accompanying drawing, in which.

DETAILED DESCRIPTION

Figure 1:
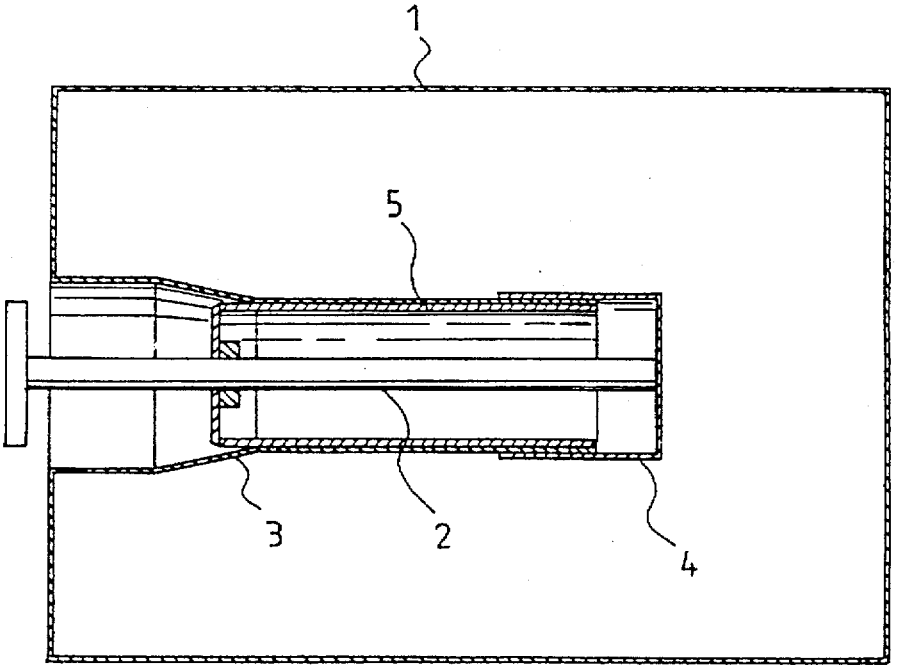
FIG. 1 is a simplified cross-section of a manually-controlled temperature-compensated resonator according to a first embodiment of the present invention.

The manually-controlled resonator shown in FIG. 1 comprises a resonator housing 1; a control rod 2 preferably made of Invar® nickel steel alloy and disposed within the housing 1 for controlling the center frequency; a conductor tube 3 which is secured to the housing 1 and coaxially disposed around the control rod 2 and which is preferably made of copper; and a regulating tube 4 which is attached to the inner end of the control rod 2, which is coaxial with the control rod 2 and the conductor tube 3, and which is preferably made of copper 4 and arranged to slide on the conductor tube 3.

In addition, the resonator comprises a temperature-compensation tube 5 disposed within the conductor tube 3 coaxially therewith and attached to the inner end of the conductor tube 3, this temperature-compensation tube 5 being mounted on the inner surface of the conductor tube 3 for compensating for longitudinal changes exhibited by the unit consisting of the control rod 2, the conductor tube 3 and the regulating tube 4 for changes in temperature. This temperature-compensation tube 5 is preferably made of aluminium, but it may also be of some other material such as plastic material. When the length of the above-mentioned components in the resonator housing 1 is suitably designed, variations in temperature do not essentially change the adjusted center frequency. An example of such design will be given below in connection with the automatic resonator to be described in the following.

Figure 2:
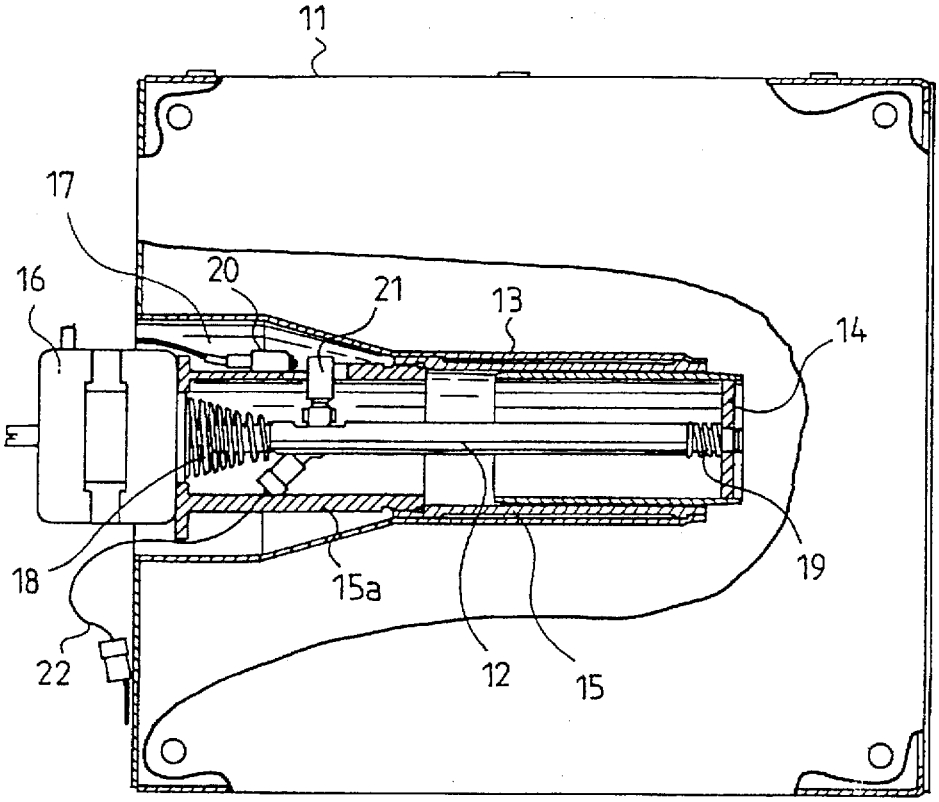
FIG. 2 is a corresponding cross-section of an automatically-controlled resonator according to a second embodiment of the invention.

FIG. 2 shows an automatically-controlled combiner comprising a resonator housing 11; a control rod 12 preferably made of Invar® nickel steel alloy and disposed within the housing 11 for controlling the center frequency; a conductor tube 13 which is secured to the housing 11 and coaxially disposed around the control rod 12 and which is preferably made of copper; and a regulating tube 14 which is coaxial with the control rod 12 and the conductor tube 13 and which is preferably made of copper; and a temperature-compensation tube 15 disposed within the conductor tube 13 coaxially therewith and attached to the inner end of the conductor tube 13, this temperature-compensation tube 15 being mounted on the inner surface of the conductor tube 13 along part of its length and having the same function as in the resonator shown in FIG. 1. The regulating tube 14 differs from the structure shown in FIG. 1 in that in this case, it is arranged to slide on the inner surface of the temperature-compensation tube 15.

The automatically-controlled resonator shown in FIG. 2 also comprises a stepper motor 16 for controlling the center resonance frequency. The stepper motor 16 is mounted at the outer end of the temperature-compensation tube 15 and disposed within an expansion 17 made to the conductor tube 13. The temperature-compensation tube 15 is constructed so that it partly consists of the installation tube 15*a* of the stepper motor. Reference number 18 indicates a spring for removing the clearance between the threads on the stepper motor 16 and on the control rod 12, and reference number 19 indicates a spring for removing the clearance between the regulating tube 14 and the end of the control rod 12. The limit switch of the stepper motor 16 is indicated by number 20, a rotation-inhibiting pin by number 21 and the grounding of the control rod by number 22.

The following is an example of how a resonator according to FIG. 2 can be designed, and which raw materials can be used in order to minimize the total thermal expansion caused by a change in temperature on the order of 100 K.

The following components are selected:

- a conductor tube which is 130 mm long and made of copper,
- a spindle of a stepper motor which is 20 mm long and made of stainless steel, a control rod which is 110 mm long and made of Invar® nickel steel alloy, and a regulating tube made of copper and having an end which is 1 mm thick.

The components listed above expand to the right in FIG. 2 as follows:

| | |
|---|---|
| 130 mm × 17 × $10^{-6}$ 1/K × 100K = | 0.2210 mm |
| 20 mm × 16 × $10^{-6}$ 1/K × 100K = | 0.0320 mm |
| 110 mm × 0.8 × $10^{-6}$ 1/K × 100K = | 0.0088 mm |
| 1 mm × 17 × $10^{-6}$ 1/K × 100K = | 0.0017 mm |
| | 0.2635 mm |

When the selected temperature-compensation tube is an aluminium tube which is 110 mm long, it expands to the left in FIG. 2 as follows:

$$110\ \text{mm} \times 23.9 \times 10^{-6}\ 1/\text{K} \times 100\ \text{K} = 0.2629\ \text{mm},$$

whereby thermal expansion to the right is 0.0006 mm, i.e. in practice 0.

In the above, the invention has been disclosed merely by means of two preferred embodiments. One skilled in the art may, however, implement the details of the invention in many alternative ways within the scope of the appended claims.

I claim:

1. A temperature-compensated resonator for providing a center resonance frequency, comprising:

a housing defining a cavity;

a conductor tube secured to said housing so as to have a longitudinally extending portion, including an axially inner end intruding into and disposed within said cavity;

a control rod extending coaxially within said conductor tube, with axial spacing therebetween; said control rod having an axially outer end which is accessible from exteriorly of said cavity for non-rotative axial movement of said control rod; said control rod having axially inner end which at least in some positions of said control rod protrudes axially inwardly beyond said axially inner end of said conductor tube;

a regulating tube having a peripheral side wall which is coaxial with said control rod, and is closed at an axially inner end by an axially inner end wall;

said regulating tube being attached to said axially inner end of said control rod for axial movement with said control rod for varying extent of protrusion of said regulating tube into said cavity;

a temperature compensator for compensating for changes exhibited by a unit consisting of said control rod, said conductor tube and said regulating tube upon changes in temperature; said temperature compensator comprising a temperature-compensation tube disposed within said conductor tube and having an axially inner end attached to the axially inner end of said conductor tube; said temperature-compensation tube being effectively connected to said control rod remotely from said axially inner end of said control rod such as to axially move said control rod in proportion to variations in temperature of said unit;

said peripheral side wall of said regulating tube being in axially sliding contact with one of said conductor tube and said temperature-compensation tube near said axially inner ends of said conductor tube and temperature compensation tube.

2. A combiner according to claim 1, wherein:

said temperature-compensation tube is coaxial with said conductor tube.

3. A combiner according to claim 1, wherein said temperature-compensation tube is disposed between said conductor tube and said regulating tube.

4. A resonator according to claim 1, further comprising:

a stepper motor for controlling the center resonance frequency, said stepper motor being disposed at an outer end of said temperature-compensation tube, partly within said conductor tube, in an expended portion of said conductor tube.

5. A resonator according to claim 4, wherein:

said temperature-compensation tube is constituted in part by an installation tube of said stepper motor.

6. A resonator according to claim 1, wherein:

said temperature-compensation tube is made of aluminum.

7. A resonator according to claim 1, wherein:

said temperature-compensation tube is made of plastic material.

* * * * *